US008893408B2

(12) United States Patent
Susman et al.

(10) Patent No.: US 8,893,408 B2
(45) Date of Patent: Nov. 25, 2014

(54) UNDERWATER EXCAVATION APPARATUS

(75) Inventors: Hector Filippus Alexander Van Drentham Susman, Aberdeen (GB); Kenneth Roderick Stewart, Aberdeen (GB)

(73) Assignee: Rotech Limited, Aberdeen (GB)

( * ) Notice: Subject to any disclaimer, the term of this patent is extended or adjusted under 35 U.S.C. 154(b) by 0 days.

(21) Appl. No.: 12/515,276

(22) PCT Filed: Nov. 26, 2007

(86) PCT No.: PCT/GB2007/004502

§ 371 (c)(1),
(2), (4) Date: Nov. 2, 2009

(87) PCT Pub. No.: WO2008/065360

PCT Pub. Date: Jun. 5, 2008

(65) Prior Publication Data

US 2010/0043256 A1 Feb. 25, 2010

(30) Foreign Application Priority Data

Nov. 29, 2006 (GB) ..... 0623806.7

(51) Int. Cl.

| | |
|---|---|
| ***B63C 11/00*** | (2006.01) |
| ***E02F 3/88*** | (2006.01) |
| ***E02F 5/00*** | (2006.01) |
| ***E02F 5/10*** | (2006.01) |

(52) U.S. Cl.

CPC ..... *E02F 3/8866* (2013.01); *E02F 5/003* (2013.01); *E02F 5/006* (2013.01); *E02F 5/107* (2013.01)

USPC ..... 37/313; 37/342; 114/338

(58) Field of Classification Search

CPC ..... E02F 3/88; E02F 3/8858; E02F 3/8875; E02F 5/104; E02F 5/105; E02F 5/107

USPC ..... 37/307, 313, 342, 344, 345; 114/312, 114/313, 330, 331, 337, 338

See application file for complete search history.

(56) References Cited

U.S. PATENT DOCUMENTS

| | | | | |
|---|---|---|---|---|
| 3,302,602 | A * | 2/1967 | Korganoff | 114/313 |
| 3,521,589 | A * | 7/1970 | Kemp | 114/330 |
| 3,635,183 | A * | 1/1972 | Keatinge | 114/330 |
| 3,719,116 | A * | 3/1973 | Burton et al. | 83/483 |
| 3,949,694 | A * | 4/1976 | Bastide | 114/313 |

(Continued)

FOREIGN PATENT DOCUMENTS

| | | |
|---|---|---|
| EP | 0 328 198 | 8/1989 |
| EP | 1 007 796 B1 | 6/2000 |

(Continued)

OTHER PUBLICATIONS

Search Report GB0623806.7, filed Apr. 23, 2007, Rotech Holdings, Ltd.

(Continued)

*Primary Examiner* — Jamie L McGowan
(74) *Attorney, Agent, or Firm* — Owens Tarabichi LLP

(57) ABSTRACT

An underwater excavation apparatus having various mechanisms for moving the underwater excavation apparatus that are provided on or adjacent to the apparatus is described. The mechanisms for moving the underwater excavation apparatus provide for orienting, positioning, rotating, counteracting reactive torque and/or steering the apparatus.

102 Claims, 6 Drawing Sheets

(56) References Cited

U.S. PATENT DOCUMENTS

| | | | | | |
|---|---|---|---|---|---|
| 4,123,858 | A | | 11/1978 | Batchelder | |
| 4,190,382 | A | * | 2/1980 | Schmitz et al. | 405/159 |
| 4,516,880 | A | * | 5/1985 | Martin | 405/160 |
| 5,607,289 | A | | 3/1997 | Sills | |
| 6,016,763 | A | * | 1/2000 | Takahashi et al. | 114/331 |
| 6,022,173 | A | | 2/2000 | Saxon | |
| 6,125,560 | A | * | 10/2000 | Beaumont | 37/344 |
| 6,374,519 | B1 | * | 4/2002 | Beaumont | 37/307 |
| 6,430,848 | B1 | * | 8/2002 | Susman et al. | 37/195 |
| 6,837,759 | B2 | | 1/2005 | Susman | |
| 2006/0150445 | A1 | * | 7/2006 | Redding | 37/317 |
| 2010/0139130 | A1 | * | 6/2010 | Wagenaar | 37/342 |

FOREIGN PATENT DOCUMENTS

| | | | |
|---|---|---|---|
| EP | 1 007 796 | B1 | 11/2003 |
| FR | 2 377 521 | A | 8/1978 |
| GB | 2 297 777 | A | 8/1996 |
| GB | 2 348 448 | A | 10/2000 |
| GB | 2 359 103 | A | 6/2001 |
| GB | 2 371 067 | A | 7/2002 |
| WO | WO 95/19488 | A1 | 7/1995 |
| WO | WO 98/27286 | A1 | 6/1998 |
| WO | WO 99/50508 | | 10/1999 |
| WO | WO 99/50508 | A1 | 10/1999 |
| WO | WO 01/192650 | A1 | 12/2001 |
| WO | WO 03/102313 | A1 | 12/2003 |
| WO | WO 2004/065700 | A1 | 8/2004 |
| WO | WO 2004/076753 | A1 | 9/2004 |

OTHER PUBLICATIONS

Exam. Report GB0623806.7, filed Jan. 22, 2010, Rotech Holdings Ltd.

* cited by examiner

UNDERWATER EXCAVATION APPARATUS

This application claims priority to prior filed foreign application GB 06 23 806.7, filed on Nov. 29, 2006, the entirety of which is hereby incorporated by reference herein.

FIELD OF INVENTION

This invention relates to an improved excavation apparatus, and in particular, to an improved underwater excavation apparatus. The invention also relates to a method of using such an excavation apparatus.

The invention also relates to an improved subsea mass flow excavation system and related method including means for orientation and placement of the system, e.g. above a cable, pipeline or structure which is typically sitting on the sea bed.

BACKGROUND TO INVENTION

Underwater excavation apparatus are known. WO 98/027286, also by the present Inventors comprises an underwater excavation apparatus comprising a hollow body having at least two inlets and at least one outlet, at least one pair of impellers rotatably mounted in the hollow body, and means for driving the impellers, wherein the at least two inlets are substantially symmetrically disposed around an axis extending from the at least one outlet. Therein, preferably, the driving means cause the impellers to be driven in contra-rotating directions, and one of the impellers is provided within one of the inlets and another of the impellers is provided within another of the inlets.

Excavators or mass flow excavation systems operate by directing a jet of high volume fluid under low pressure at the sea bed to displace sea bed material. The excavator is tethered from a vessel by means of a crane wire, which is used to lower and retrieve the excavator, and to maintain a given distance from the sea bed or structure requiring excavation, such as a subsea oil or gas pipeline. In order to control the excavation, sonar detection means are used to allow the excavator operator to view the excavation in real time. Cameras and metal detection means can also be used to assist the operator.

During the excavation of a pipeline or cable the excavator is typically required to follow the direction of the pipeline. This is achieved by moving the vessel along the pipeline, using the dynamic positioning (DP) of the vessel, while the DP operator references the sonar images relayed to surface. In order to follow the line, and to view the excavation process, it is essential that the correct orientation of the excavator is maintained to ensure the sonar is correctly positioned above the line. Present art utilises tugger lines (taut lines attached to the excavator) to maintain and adjust orientation. In inclement weather, wind and tide direction may require the vessel to take a heading different from the direction of the line to be excavated, making it exceedingly difficult to keep the correct orientation of the excavator and the sonar due to the difference in ship's heading and pipeline direction. In subsea excavation apparatus using a single impeller as in U.S. Pat. No. 5,607,289 reactive torque created by the impeller makes the excavation apparatus unstable in the water.

It is an object of at least one embodiment of at least one aspect of the present invention to seek to obviate or at least mitigate one or more of the aforementioned problems in the prior art.

It is a further object of at least one embodiment of at least one aspect of the present invention to seek to obviate or at least mitigate one or more problems in the prior art.

SUMMARY OF INVENTION

One or more objects of the present invention are achieved by the general solution of providing an underwater excavation apparatus comprising a means for moving the apparatus.

According to a first aspect of the present invention there is provided an underwater excavation apparatus comprising at least one means for moving the underwater excavation apparatus, the at least one moving means being provided on or adjacent to the underwater excavation apparatus.

The at least one moving means may comprise means for orienting, positioning, rotating (e.g. in use around at least one substantially vertical axis and/or at least one horizontal axis), counteracting reactive torque and/or steering the apparatus.

The/each moving means may allow for required achievement and maintenance of a desired position/orientation of the apparatus.

The moving means may be capable of moving the apparatus:

forward and/or backward;

to one side and/or to another side;

up and/or down;

rotationally around a vertically extending axis in one and/or another direction rotatably around at least one (or two perpendicular) horizontally extending axis (axes) in one and/or another direction.

The moving means may cause, in use, one or more jets of fluid, e.g. of the underwater fluid.

The moving means may comprise a plurality of moving means.

In one arrangement the moving means may comprise at least one pair of moving means, which may be substantially symmetrically disposed on or adjacent to the apparatus, for example, a first pair of moving means may be disposed at or adjacent an upper surface of the apparatus and/or at or near adjacent ends of the apparatus. Further, or alternatively, a second pair of moving means may be disposed at or adjacent to respective opposing faces of the apparatus. The moving means may be connected/connectable to the excavation apparatus, e.g. by connection means such as brackets or arms.

The Applicant has termed the/each moving means as a "thruster".

The/each moving means may comprise at least one impeller/propeller/blade, i.e. mounted for rotation.

The/each moving means may comprise a body having a through passage, e.g. a hollow cylindrical body.

The/each respective impeller may be mounted in the respective cylindrical body for rotation around a longitudinal axis of the through passage.

The apparatus may comprise means for driving the/each impeller.

The/each driving means may comprise an electrically or hydraulically drive means.

The/each driving means may be adapted to selectably drive the respective impeller in either direction of rotation.

Alternatively (and advantageously) the driving means may be adapted to drive the respective impeller in a single direction of rotation.

In use, the impellers of a pair of moving means may be caused to rotate in different directions so as to cause the apparatus to rotate around a substantially vertically extending axis.

In use, the impellers of a pair of moving means may be caused to rotate in the same direction so as to cause the apparatus to move in a selected direction, e.g. forward, backward or to one side or another.

The/each moving means may comprise a nozzle and valve arrangement.

For example, there may be provided at least one pair of opposing nozzles and associated valves to provide for rotational movement in either direction around a substantially vertically extending axis.

In an advantageous arrangement there are provided two pairs of nozzles at either end of the apparatus. Suitable control of the valves provides that, in use, the apparatus can be caused to rotate and/or move, fore and aft, and/or from side to side.

The apparatus may comprise means for connecting or tethering and/or securing the apparatus to a vessel.

The means for connecting, tethering, and/or securing may comprise at least one eye, the/each eye being capable of receiving a cable, line or tether extending from the vessel.

The at least one eye may comprise at least one pair of eyes, which pair of eyes may be substantially symmetrically disposed on the apparatus, e.g. on an uppermost surface thereof at or adjacent opposing ends thereof.

In use, the means for connecting, tethering and/or securing may be used to roughly, approximately or "coarsely" position and/or locate the apparatus, (e.g. by movement of the vessel and/or operation of the dynamic positioning of the vessel), while the moving means may be used to more exactly, precisely or "finely" position, locate and/or orientate the apparatus.

In an advantageous implementation the underwater excavation apparatus comprises a hollow body, e.g. a hollow body having at least one inlet and at least one outlet, preferably at least one pair of impellers rotatably mounted in the hollow body and preferably further means for driving the impellers.

Advantageously, the further driving means cause the impellers to be driven in contrary rotating directions, in use.

The at least one inlet may be inclined at an angle to an axis along which the at least one outlet is provided.

Preferably there is provided at least one pair of inlets.

Preferably the at least one pair of inlets are substantially symmetrically disposed around an axis extending from the outlet.

In one embodiment the underwater excavation apparatus may comprise a pair of horizontally or at least partly horizontally opposed inlets communicating with a single outlet, the outlet advantageously being disposed vertically downwards substantially midway between the two inlets, in use. In this case, the excavation apparatus may, therefore, be substantially "T" shaped in profile.

In an alternative embodiment the underwater excavation apparatus may comprise a pair of inlets communicating with a single outlet, the inlets being substantially symmetrically disposed around an axis extending from the outlet, the outlet being disposed vertically downwards substantially midway between the two inlets, in use. In this case, the excavation apparatus may, therefore, be substantially "Y" shaped in profile.

Advantageously, the outlets are each spaced/inclined substantially 45° from the axis extending from the outlet.

At least one impeller may be provided within/adjacent each inlet.

The means for driving the/each impeller(s) may include at least one drilling motor.

The at least one drilling motor may comprise a stator and a rotor rotatably mounted in the stator, the stator being provided with a rod recess and an exhaust port, the rotor being provided with a rotor channel and at least one channel for conducting motive fluid from the rotor channel to a chamber between the rotor and the stator, the rod recess being provided with a rod, which in use, forms a seal between the stator and the rotor.

Although not essential it is highly desirable that the rotor be provided with a seal or seal member for engagement with the stator.

Preferably, the seal(s) or seal member is/are made from a material selected from the group consisting of plastics material, polyethylethylketone, metal, copper alloys and stainless steel.

Advantageously, the rod is made from a material selected from the group consisting of plastics material, polyethylethylketone, metal, copper alloys and stainless steel.

Preferably, the stator is provided with two rod recesses which are disposed opposite one another, and two exhaust ports which are disposed opposite one another, each of the rod recesses being provided with a respective rod, the rotor having two seals which are disposed opposite one another.

The drilling motor may advantageously comprise two drilling motors arranged with their respective rotors connected together each motor comprising a stator and a rotor rotatably mounted in the stator, the stator being provided with a rod recess and an exhaust port, the rotor being provided with a rod recess and an exhaust port, the rotor being provided with a rotor channel and at least one channel for conducting motive fluid from the rotor channel to a chamber between the rotor and the stator, the rod recess being provided with a rod, which, in use, forms a seal between the stator and the rotor.

Preferably, the drilling motors are connected in parallel, although the drilling motors could be connected in series if desired.

Advantageously, the drilling motors are arranged so that, in use, one drilling motor operates out of phase with the other. Thus, in a preferred embodiment each drilling motor has two chambers and the chambers in the first drilling motors are 90° out of phase with the chambers in the second drilling motor. Similarly, in an embodiment in which each drilling motor has four chambers, the chambers in the first drilling motor would preferably be 45° out of phase with the chambers on the second drilling motor. This arrangement helps to ensure smooth power output and inhibits stalling.

Alternatively, the at least one drilling motor may be a "Moineau" motor, hydraulic motor or a suitably adapted electric motor.

The impellers may be driven by means of a gearbox or by exploitation of the opposing reactive torque on a drive body of the motor.

When the reactive torque upon the motor body is utilised, at least one impeller may be connected to an output shaft of the motor, while at least one other impeller may be connected to the motor body.

Alternatively the impellers may be driven by a pair of motors operating in opposite directions. In such case the motors and impellers may be balanced and may be run at equal speed.

The underwater excavation apparatus may further comprise an agitator device having mechanical disturbance means and fluid flow disturbance means.

The underwater excavation apparatus may, in use, be suspended from a surface vessel or mounted upon a sled of the type currently known for use in subsea excavation operations.

Preferably the underwater apparatus may comprise a hollow body having a pair of inlets communicating with an outlet, at least one pair of impellers rotatably mounted in the hollow body and means for driving the impellers, the inlets being substantially symmetrically disposed around an axis extending from the outlet, wherein the inlets are not horizontally opposed to one another.

According to a second aspect of the present invention there is provided a method of underwater excavation comprising:

providing an excavation apparatus according to the first aspect of the present invention;

excavating an underwater area using the apparatus.

BRIEF DESCRIPTION OF DRAWINGS

Embodiments of the present invention will now be described by way of example only, and with reference to the accompanying drawings, which are.

DETAILED DESCRIPTION OF DRAWINGS

Figure 1:
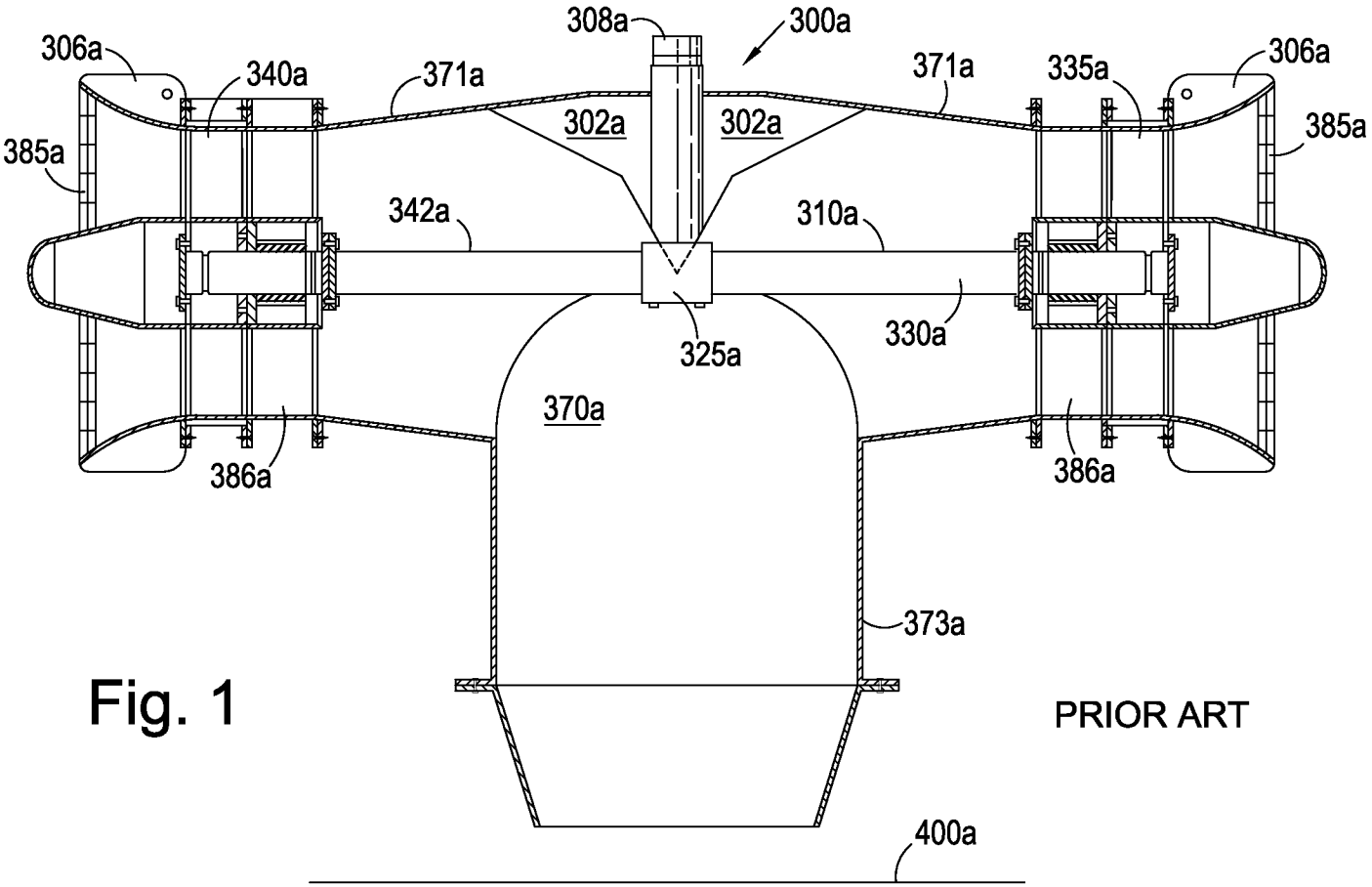
PRIOR ART Fig. 1
FIG. 1 a front cross-sectional view of a first excavation apparatus according to the prior art.

Referring to FIG. 1, there is shown a first embodiment of an underwater excavation apparatus 300*a* according to the prior art. The apparatus 300*a* comprises a hollow body 370*a* formed from a pair of horizontally opposed inlet ducts 371*a* and an outlet duct 373*a*, a drive motor 310*a* and a pair of impellers 335*a*, 340*a*.

The apparatus 300*a* is further provided with deflection baffles 302*a* within the hollow body 370*a*, suspension brackets 306*a* to enable the apparatus 300*a* to be suspended from a surface vessel, guide vanes 386*a*, to regulate the flow of fluid past the impellers 335*a*, 340*a*, and safety grids 385*a* to seek to prevent the ingress of solid matter which may damage the impellers 335*a*,340*a*. In this first prior art excavator, the drive motor 310*a* is provided along an axis common to the horizontally opposed inlet ducts 371*a* and impellers 335*a*, 340*a*. An output shaft 330*a* of the motor 310*a* is connected to a first impeller 335*a* while the second impeller 340*a* is attached to a shaft 342*a* connected via a swivel 325*a* to an outer housing of the drive motor 310*a*.

In use, motive fluid is supplied to the motor 310*a* via fluid inlet 308*a* which in turn causes the output shaft 330*a* and impeller 335*a* to rotate. Reactive torque from this rotation causes the outer housing of the drive motor 310*a* to rotate in a direction opposite to that of the output shaft 330*a*. This in turn results in the rotation of the second impeller 340*a*. The impellers 335*a*, 340*a* are configured such that, despite rotating in opposite directions, they each provide an equal flowrate of water into the hollow body 370*a*. Water drawn into the hollow body 370*a* thus is directed via the deflection baffles 302*a* through the outlet duct 373*a* and towards the sea bed 400*a*.

The shaft 342*a* and swivel 325*a* may, in an alternative embodiment, be replaced by a second motor which directly drives the impeller 340*a*, as described with reference to FIG. 2.

The excavation device 300*a* may be suspended, for example, from the bow or stern of a surface vessel, or through a moonpool of a dedicated subsea operations vessel.

The excavation apparatus 300*a* may further be provided with an agitator device (not shown) having mechanical disturbance means and fluid flow disturbance means.

In an advantageous version the motor 310*a* comprises a drilling motor, such as that disclosed in WO 95/19488, the content of which is incorporated herein by reference.

The drilling motor 310*a* may comprise a first motor and a second motor, substantially the same as that disclosed in EP 1 007 796 B1.

Figure 2:
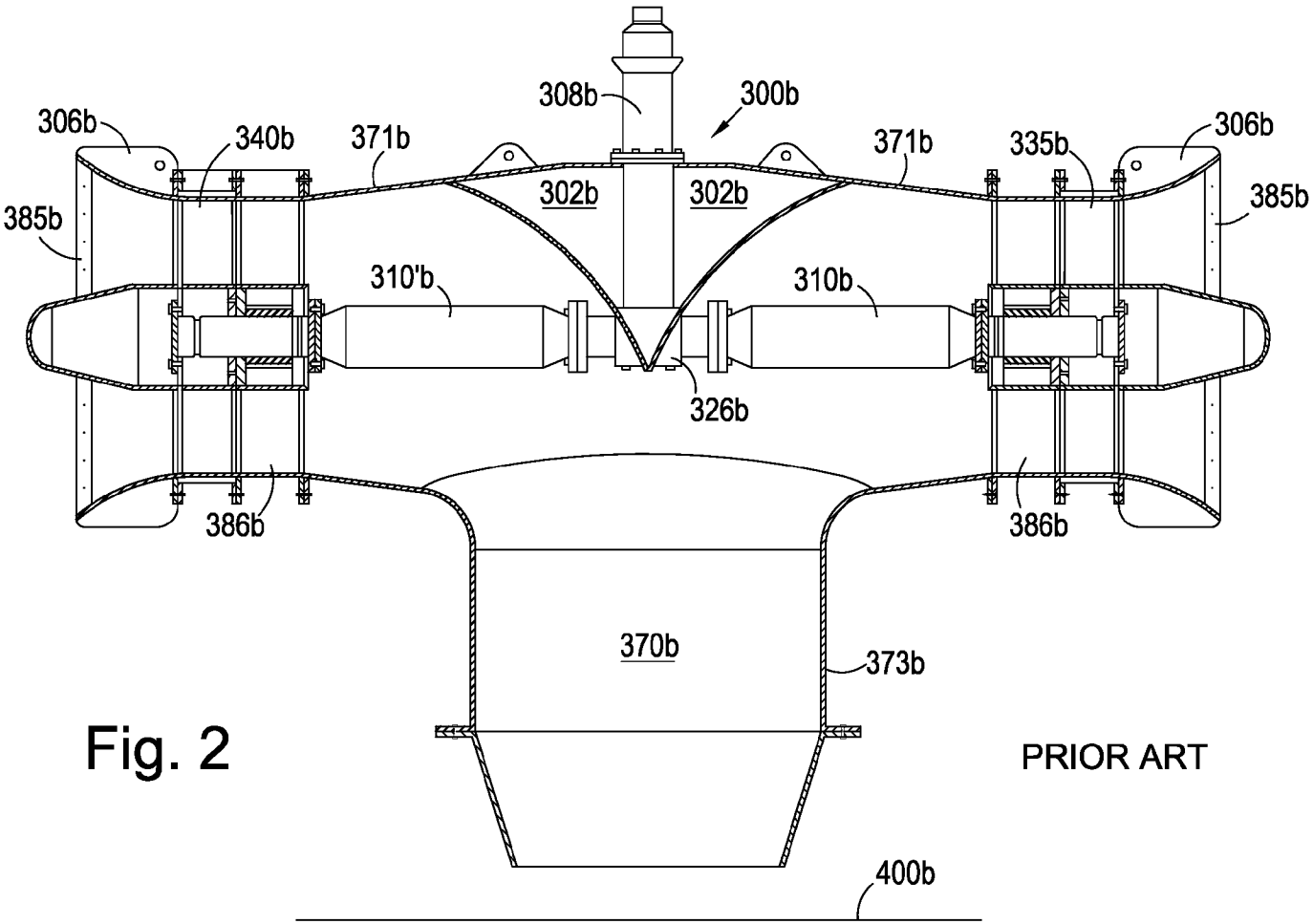
PRIOR ART Fig. 2
FIG. 2 a front cross-sectional view of a second excavation apparatus according to the prior art.

Referring now to FIG. 2, there is shown a second prior art underwater excavation apparatus 300*b*. like parts of the apparatus 300*a* are identified by numerals used to identify parts of the apparatus 300*a* of FIG. 1, except subscripted with "b" rather than "a".

The apparatus 300*b* differs from the apparatus 300*a* in that the shaft 342*a* and swivel 325*a* are replaced by a second motor 310'*b* and a T-coupling 326*b*. Thus, in this embodiment the impellers 335*b*, 340*b* are driven by respective motors 310*b*,310'*b*. In use, motive fluid is supplied to motors 310*b*, 310'*b* via fluid inlet 308*b* and T-coupling 326*b*.

Figure 3A:
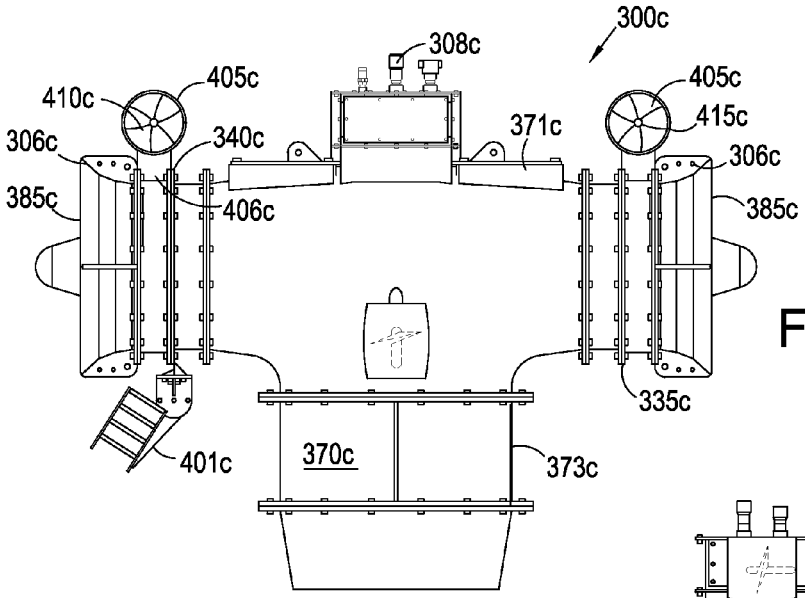
FIGS. 3(*a*) to (*c*) front, side and top views of a first embodiment of an excavation apparatus according to the present invention.
Figure 3B:
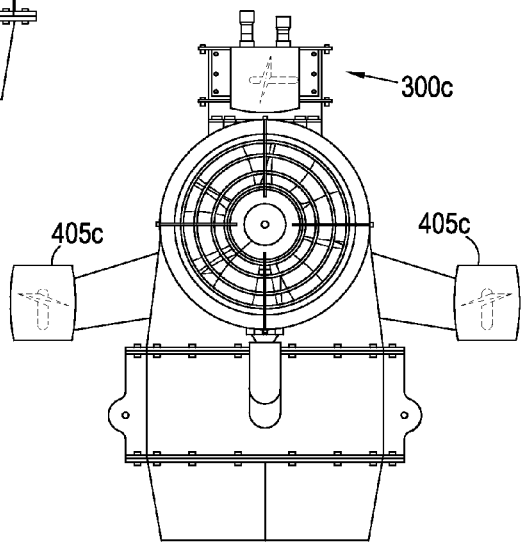
Figure 3C:
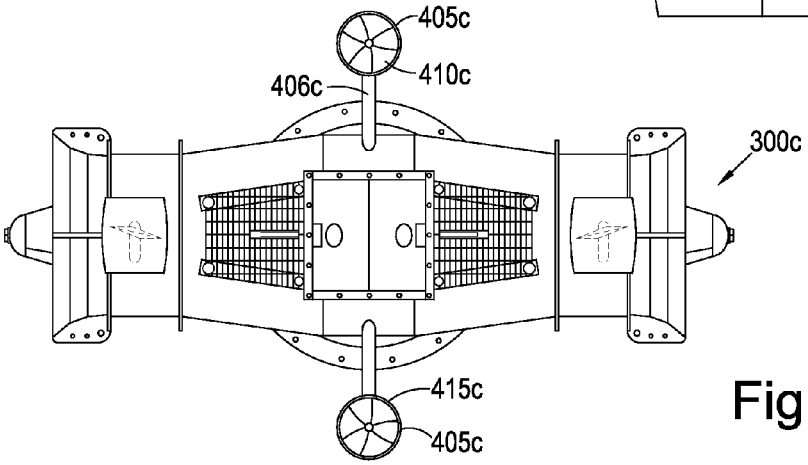

Referring to FIGS. 3(*a*) to 3(*c*), there is shown an underwater excavation apparatus, generally designated 300*c*, according to a first embodiment of the present invention. The apparatus 300*c* is similar to the apparatus 300*a* or 300*b* in many respects, like parts being denoted by like numerals, except suffixed "c".

As can be seen from FIG. 3(*a*), the apparatus 300*c* includes a sonar head 401*c*. The apparatus 300*c* also comprises at least one means 405*c* for moving the underwater excavation apparatus, the at least one moving means 405*c* being provided on or adjacent to the underwater excavation apparatus 300*c*.

The at least one moving means 405*c* comprises means for orientating, positioning, rotating (e.g. in use, around at least one substantially vertical axis, and at least one substantially horizontal axis), counteracting reactive torque and/or steering the apparatus 300*c*.

The moving means 405*c* is capable of moving the apparatus 300*c*:

forward and/or backward;

to one side and/or to another side;

up and/or down;

rotationally around a vertically extending axis in one and/or another direction rotatably around at least one (or two perpendicular) horizontally extending axis (axes) in one and/or another direction.

The/each moving means 405*c* allows for required achievement and maintenance of a desired position/orientation of the apparatus.

The moving means causes, in use, one or more jets of fluid, e.g. of the underwater fluid.

The moving means 405*c* comprises a plurality of moving means 405*c*, connected to the apparatus 300*c* by connection means 406*c*, such as brackets, arms or the like.

In this arrangement the moving means 405*c* comprises a pair of moving means 405*c*, which are substantially symmetrically disposed on or adjacent to the apparatus 405*c*. The pair of moving means 405*c* are disposed at or adjacent an upper surface of the apparatus 300*c*, and at or near adjacent ends of the apparatus 300*c*. The apparatus 300*c* further comprises a further pair of moving means 405*c* placed on a respective sides of the apparatus 300*c*.

The Applicant has termed the/each moving means 405*c* as a "thruster".

The/each moving means 405*c* comprises an impeller/propeller/blade 410*c*. The/each moving means 405*c* also comprises a body 415*c* having a through passage, e.g. a hollow cylindrical body. The/each respective impeller 410*c* is mounted in the respective cylindrical body 415*c* for rotation around a longitudinal axis of the through passage.

The apparatus 300*c* also comprises means for driving the/each impeller (not shown). The/each driving means typically comprises an electrically or hydraulically drive means (not shown). Such is controllable from surface, e.g. via an umbilical. The driving means can be adapted to drive the respective impeller 410*c* in either direction of rotation. Alternatively (and advantageously—e.g. due to simplicity) the driving means can be adapted to drive the respective impeller 410*c* in a single direction of rotation.

In use, the impellers 410*c* of a pair of moving means can be caused to rotate in different direction so as to cause the apparatus 300*c* to rotate around a substantially vertically extending axis.

In use, the impellers 410*c* of a pair of moving means 405*c* can be caused to rotate in the same direction so as to cause the apparatus to move in a selected direction, e.g. forward, backward or to one side or another.

The apparatus 300*c* comprises means for connecting or tethering and/or securing the apparatus 300*c* to a vessel.

In use, the means for connecting, tethering, and/or securing typically comprises at least one eye, the/each eye being capable of receiving a cable, line or tether extending from the vessel. The at least one eye can comprise at least one pair of eyes, which pair of eyes are substantially symmetrically disposed on the apparatus 300*c*, e.g. on an uppermost surface thereof at or adjacent opposing ends thereof.

The means for connecting, tethering and/or securing can be used to roughly, approximately or "coarsely" position and/or locate the apparatus 300*c*, while the moving means can be used to more exactly, precisely or "finely" position, locate and/or orientate the apparatus 300*c*.

In use, orientation can be achieved and maintained by exerting thrust on the apparatus 310*c* or "excavator" from a jet, or jets, of fluid generated by the moving or thrusting means 405*c* attached to the excavator. The thruster means can be an electrically or hydraulically driven propeller rotating within a tubular housing, whereby the propeller tips are in close proximity to the tubular housing. An open propeller may be used but is less efficient. With rotation of the propeller, fluid is moved through the housing and reactive thrust is exerted upon the housing and to the excavator, thus causing the excavator to move. A single thruster is sufficient to maintain orientation if it is capable of reverse operation, i.e. reverse operation of the electric or hydraulic motor will cause the propeller to rotate in the opposite direction, directing the jet of fluid (and thus thrust) in the opposite direction.

For efficient burial it is also important to keep the fluid flow emanating from the excavator beside and/or over the line. Lateral positioning of the excavator is normally achieved by movement of the vessel. However, with the use of two thrusters the operator can control the excavator's lateral position relative to the line. To achieve this the operator may:

(1) Adjust azimuthal control to achieve the desired orientation;
   (a) using a single thruster or
   (b) two thrusters acting in opposing directions.
(2) Thereafter adjust lateral position using the two thrusters together.

Rather than manually fixing orientation, it is preferable to derive a control signal from circuitry with reference to a compass located on the excavator, and thus automate azimuthal control and positioning of the sonar or metal detection apparatus above the subsea cable or pipeline.

The use of the above arrangement enables the excavator to be used from vessels with lower grade dynamic positioning, e.g. DP I, as opposed to DP II or greater, where the number indicates the quality of the positioning equipment used.

Figure 4:
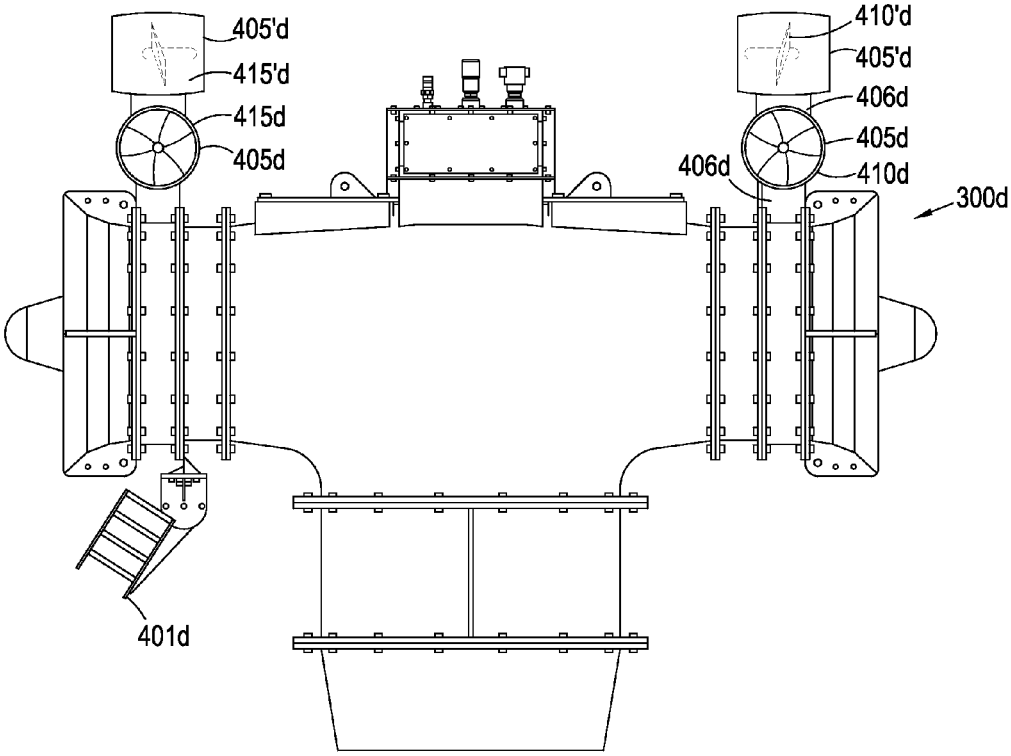
FIG. 4 a front view of a second embodiment of an excavation apparatus according to the present invention.

Referring now to FIG. 4, there is shown a side view of second embodiment of an excavation apparatus, generally designated 300*d*, according to the present invention. The apparatus 300*d* is similar to the apparatus 300*a*, 300*b* or 300*c* in many respects, like parts being denoted by like numerals, except suffixed "d".

The apparatus 300*d* differs from the apparatus 300*c* in providing a pair of moving means 405*d* on either end of the apparatus 400*d*, and an additional pair of moving means 405'*d* facing outwards, so as to provide for side to side movement.

Figure 5A:
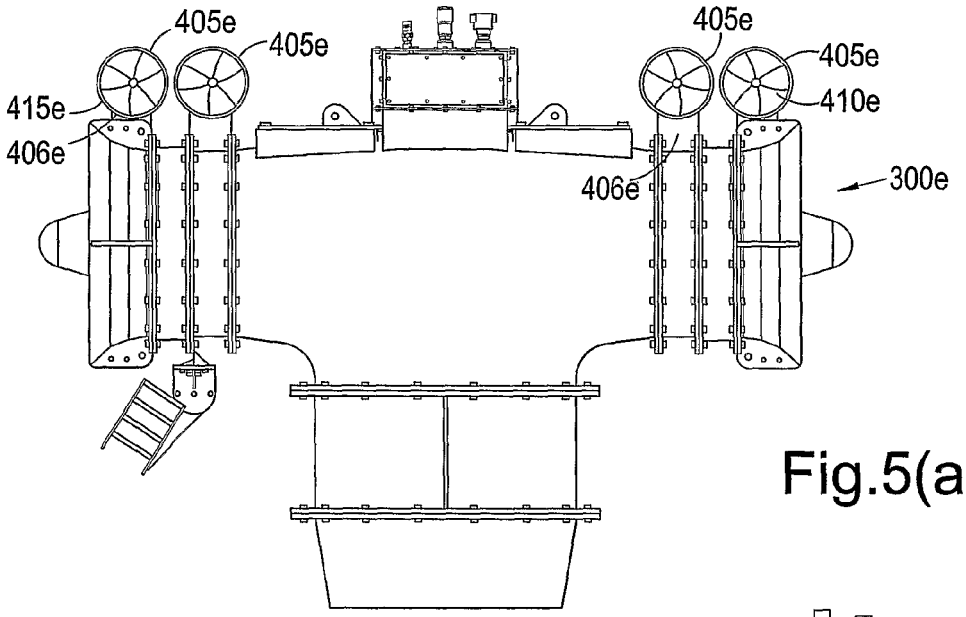
FIGS. 5(*a*) to (*c*) front, side and top views of a third embodiment of an excavation apparatus according to the present invention.
Figure 5B:
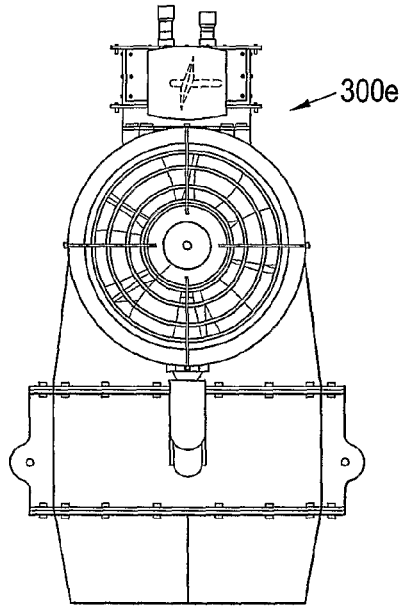
Figure 5C:
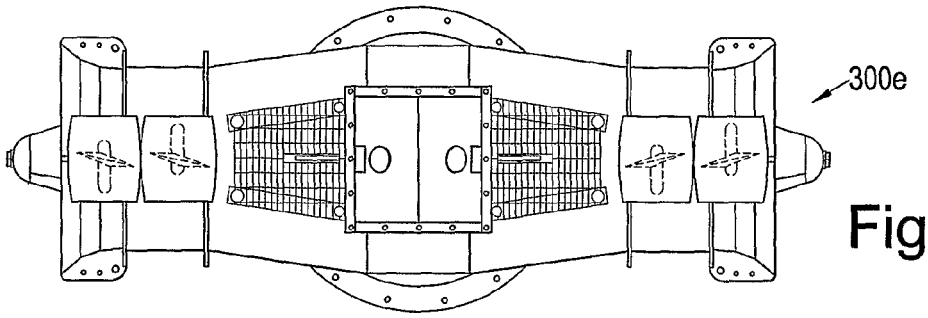

Referring now to FIGS. 5(*a*) to 5(*c*), there is shown a third embodiment of an excavation apparatus, generally designated 300*e*, according to the present invention. The apparatus 300*e* is similar to the apparatus 300*a*, 300*b*, 300*c* or 300*d* in many respects, like parts being denoted by like numerals, except suffixed "e".

The apparatus 300*e* differs from the apparatus 300*b* in that an additional pair of moving means 405*e* are provided on top of the apparatus 300*e*. Therefore, in the apparatus 300*e* there is provided two moving means at either end. One of the two at either end having a impeller that rotates in one direction, and the other of the two at the other end of the impeller that rotates in a contrary direction.

Figure 6:
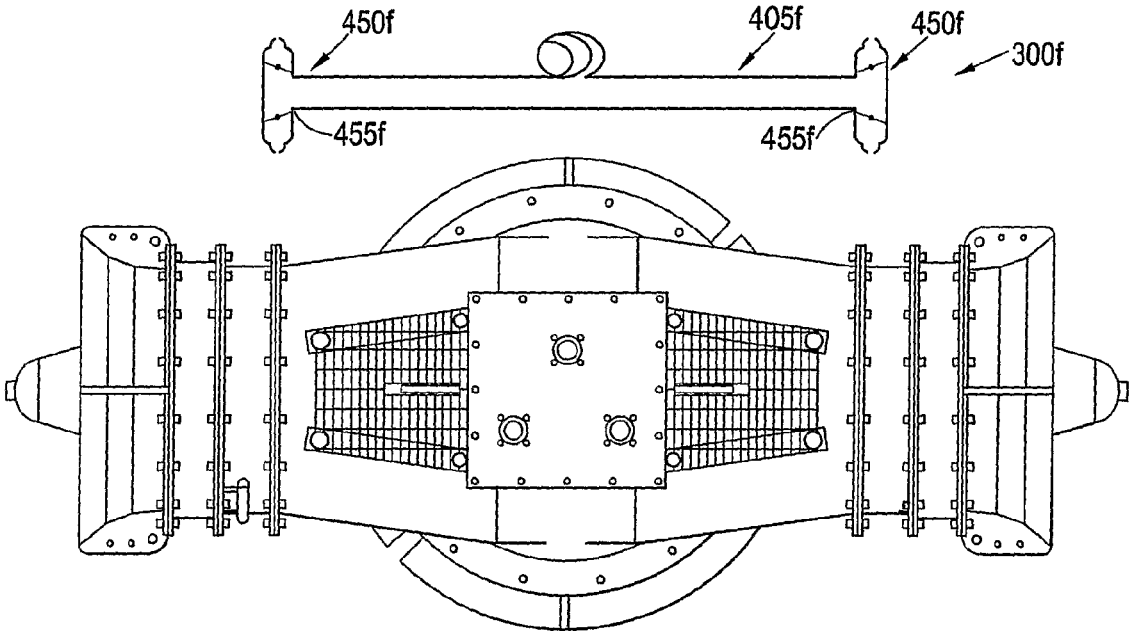
FIG. 6 a top view of a fourth embodiment of an excavation apparatus according to the present invention.

Referring now to FIG. 6, there is shown a fourth embodiment of an excavation apparatus, generally designated 300*f*, according to the present invention.

In this embodiment the/each moving means 405*f* comprises a nozzle and valve arrangement. For example, there can be provided at least one pair of opposing nozzles 405*f* and associated valves 455*f* to provide for rotational movement in either direction around a substantially vertically extending axis.

In an advantageous arrangement there are provided two pairs of nozzles 450*f* at either end of the apparatus 300*f*. Suitable control of the valves 455*f* provides that, in use, the apparatus 300*f* can be caused to rotate and/or move, fore and aft, and/or from side to side.

The moving or thruster means 405*f* can therefore be provided by a vector thrust mechanism, with a central power source, such as a mixed flow or centrifugal pump, pumping fluid into a manifold with a plurality of outlet nozzles.

Control valves can be used to open and close each nozzle. In this embodiment an opposing pair of controlled nozzles can replace a reversible propeller arrangement.

The pump and nozzle arrangement shown can be mounted on the top of the excavator.

It will be appreciated that the embodiments of the present invention hereinbefore described are given by way of example only, and are not meant to be limiting to the scope of the invention in any way.

For example, although the disclosed embodiments are generally "T" shaped, other housing shapes may be envisaged. For example, "Y" shaped as disclosed in EP 1 007 796 B1.

It may be envisaged that the moving means (thrusters) may be provided on or mounted, e.g. detachably attachably, to a frame, which frame may be detachably attachable to the excavator apparatus. This may facilitate retro-fitting of thrusters to existing excavator apparatus. The frame may also facilitate provision of a power pack, e.g. attached to surface by an electrical umbilical cable, the power pack powering the impellers/thrusters. This may be advantageous in "deep water"

It will also be appreciated that the various moving means of the various disclosed embodiments may be combined so as to provide for greater control, or a greater number of degrees of freedom of movement of the apparatus.

The invention claimed is:

1. An underwater excavation apparatus comprising means for providing a flow of underwater fluid comprising a hollow body having at least one first inlet portion comprising at least one respective first inlet, at least one second inlet portion comprising at least one respective second inlet and at least one outlet portion, the at least one first and second inlet portions being substantially symmetrically disposed around a first axis extending from the outlet portion, the at least one first and second inlets being opposed to one another, at least one pair of impellers rotatably mounted coaxially in the hollow body and means for driving the impellers, wherein, in use, the driving means cause the impellers to be driven in contrary rotating directions, and at least one means for moving the underwater excavation apparatus during excavation comprising at least one first and at least one second moving means, the at least one first and second moving means being provided above the respective at least one first and second inlet portions for counteracting reactive torque of the underwater excavation apparatus, wherein the at least one first and second moving means each comprises at least one further impeller mounted for rotation in a common plane of rotation, the common plane of rotation being coincident with the first axis and with a second axis which extends between the first and second inlets and which perpendicularly intersects the first axis.

2. An underwater excavation apparatus as claimed in claim 1, wherein the at least one moving means comprise means for orienting, positioning, rotating, and/or steering the apparatus.

3. An underwater excavation apparatus as claimed in claim 1, wherein the/each moving means allows for required achievement and maintenance of a desired position/orientation of the apparatus.

4. An underwater excavation apparatus as claimed in claim 1, wherein the moving means is capable of moving the apparatus:

forward and/or backward;

to one side and/or to another side;

up and/or down;

rotationally around a vertically extending axis in one and/or another direction rotatably around at least one/two perpendicular horizontally extending axis/axes in one and/or another direction.

5. An underwater excavation apparatus as claimed in claim 1, wherein the moving means causes production of one or more jets of underwater fluid.

6. An underwater excavation apparatus as claimed in claim 1, wherein the moving means comprise a plurality of moving means.

7. An underwater excavation apparatus as claimed in claim 1, wherein the moving means comprise at least one pair of moving means, which are substantially symmetrically disposed on or adjacent to the at least one first and second inlet portions of the apparatus.

8. An underwater excavation apparatus as claimed in claim 7, wherein a first pair of moving means are disposed at or adjacent an upper surface of the at least one first and second inlet portions of the apparatus and/or at or near opposing ends of the at least one first and second inlet portions of the apparatus.

9. An underwater excavation apparatus as claimed in claim 7, wherein a pair/second pair of moving means are disposed at or adjacent to respective opposing faces of the apparatus.

10. An underwater excavation apparatus as claimed in claim 1, wherein the moving means are connected/connectable to the excavation apparatus.

11. An underwater excavation apparatus as claimed in claim 1, wherein the/each moving means comprise a body having a through passage.

12. An underwater excavation apparatus as claimed in claim 11, wherein the/each respective further impeller is mounted in the respective body for rotation around a longitudinal axis of the through passage.

13. An underwater excavation apparatus as claimed in claim 1, wherein the apparatus comprises means for driving the/each further impeller.

14. An underwater excavation apparatus as claimed in claim 13, wherein the/each driving means comprises an electrical or hydraulic drive means.

15. An underwater excavation apparatus as claimed in claim 13, wherein the/each driving means is adapted to selectably drive the respective further impeller in either direction of rotation.

16. An underwater excavation apparatus as claimed in claim 13, wherein the driving means is adapted to drive the respective further impeller in a single direction of rotation.

17. An underwater excavation apparatus as claimed in claim 7, wherein, the further impellers of the pair of moving means are rotatable in different directions so as to cause the apparatus to rotate around a substantially vertically extending axis.

18. An underwater excavation apparatus as claimed in claim 7, wherein, the further impellers of a pair of moving means are caused to rotate in the same direction so as to cause the apparatus to move in a direction, selected from one of forward, backward to one side and to another side.

19. An underwater excavation apparatus as claimed in claim 1, wherein the apparatus comprises means for connecting or tethering and/or securing the apparatus to a vessel.

20. An underwater excavation apparatus as claimed in claim 19, wherein the means for connecting, tethering, and/or securing comprises at least one eye, the/each eye being capable of receiving a cable, line or tether extending from the vessel.

21. An underwater excavation apparatus as claimed in claim 20, wherein the at least one eye comprises at least one pair of eyes, which pair of eyes are substantially symmetrically disposed on the apparatus, such as on an uppermost surface thereof at or adjacent opposing ends thereof.

22. An underwater excavation apparatus as claimed in claim 19, wherein, the means for connecting, tethering and/or securing are adapted to roughly, approximately or coarsely position and/or locate the apparatus, and the at least one moving means is adapted to more exactly, precisely or finely position, locate and/or orientate the apparatus.

23. An underwater excavation apparatus as claimed in claim 1, wherein each inlet portion is inclined at an angle to the first axis along which the at least one outlet portion is provided.

24. An underwater excavation apparatus as claimed in claim 1, wherein the first and second inlets are substantially symmetrically disposed around the first axis extending from the outlet portion.

25. An underwater excavation apparatus as claimed in claim 1, wherein the at least one outlet portion comprises a single outlet and the at least one first and second inlet portions comprises at least one horizontally, or at least partly horizontally, opposed first and second respective inlets, the first and second inlets communicating with the single outlet, the single outlet being disposed vertically downwards substantially midway between the first and second inlets.

26. An underwater excavation apparatus as claimed in claim 1, wherein the at least one first and second inlets communicate with a single outlet, the first and second inlets being substantially symmetrically disposed around the first axis extending from the single outlet, the single outlet being disposed vertically downwards substantially midway between the first and second inlets.

27. An underwater excavation apparatus as claimed in claim 26, wherein the inlets are each spaced/inclined substantially 45° from the first axis extending from the outlet.

28. An underwater excavation apparatus as claimed in claim 24, wherein at least one impeller(s) is provided within/adjacent each inlet.

29. An underwater excavation apparatus as claimed in claim 1, wherein the underwater excavation apparatus is suspendable from a surface vessel or mountable upon a sled.

30. An underwater excavation apparatus as claimed in claim 1, wherein the at least one first and second inlet portions comprises a plurality of inlets portions comprising a plurality of respective inlets and the inlets portions are substantially symmetrically disposed around the first axis extending from the at least one outlet portion, and wherein the inlets are not horizontally opposed to one another.

31. A method of underwater excavation comprising:

providing an excavation apparatus according to claim 1; and excavating an underwater area using the apparatus.

32. An underwater excavation apparatus as claimed in claim 1, wherein the at least one outlet portion is provided vertically between the at least one first and second moving means and the at least one first and second inlet portions.

33. An underwater excavation apparatus is claimed in claim 1, wherein the at least one outlet portion comprises at least one outlet, the at least one outlet is downward facing and the at least one first and second inlets are laterally facing.

34. An underwater excavation apparatus comprising a hollow body having at least one first inlet portion comprising at least one respective first inlet, at least one second inlet portion comprising at least one respective second inlet and at least one outlet portion, the at least one first and second inlet portions being substantially symmetrically disposed around first axis extending from the outlet portion, the at least one first and second inlets being opposed to one another, at least one pair of impellers rotatably mounted in the hollow body, means for driving the impellers, and at least one means for moving the underwater excavation apparatus during excavation comprising at least one first and at least one second moving means, the at least one first and second moving means being above the respective at least one first and second inlet portions for counteracting reactive torque of the underwater excavation apparatus, wherein the first and second moving means are arranged on a common plane, the common plane being coincident with the first axis and with a second axis, the second axis extending between the first and second inlets and perpendicularly intersecting the first axis.

35. An underwater excavation apparatus as claimed in claim 6, wherein the plurality of moving means is provided at or adjacent to first and second respective inlets of the first and second inlet portions.

36. An underwater excavation apparatus as claimed in claim 1, wherein the first and second inlets portions comprise at least one first and second respective branch of the hollow body.

37. An underwater excavation apparatus comprising means for providing a flow of underwater fluid comprising a hollow body having at least one first inlet portion comprising at least one respective first inlet, at least one second inlet portion comprising at least one respective second inlet and at least one outlet portion, the at least one first and second inlet portions being substantially symmetrically disposed around a first axis extending from the outlet portion, the at least one first and second inlets being opposed to one another, at least one pair of impellers rotatably mounted coaxially in the hollow body and means for driving the impellers, wherein, in use, the driving means cause the impellers to be driven in contrary rotating directions, and at least one means for moving the underwater excavation apparatus during excavation comprising at least one first and at least one second moving means, the at least one first and second moving means being provided above the respective at least one first and second inlet portions for counteracting reactive torque of the underwater excavation apparatus, wherein the at least one first and second moving means each comprises a nozzle and valve arrangement, wherein the first and second moving means are arranged on a common plane, the common plane being coincident with the first axis and with a second axis, the second axis extending between the first and second inlets and perpendicularly intersecting the first axis.

38. An underwater excavation apparatus as claimed in claim 37, wherein there are provided at least one pair of opposing nozzles and associated valves to provide for rotational movement in either direction around a substantially vertically extending axis.

39. An underwater excavation apparatus as claimed in claim 37 wherein there are provided two pairs of nozzles at either end of the inlet portions of the apparatus, control of the valves such that the apparatus can be caused to rotate and/or move, fore and aft, and/or from side to side.

40. A method of underwater excavation comprising:

providing an excavation apparatus according to claim 37;

excavating an underwater area using the apparatus.

41. An underwater excavation apparatus as claimed in claim 37, wherein the first and second inlets portions comprise at least one first and second respective branch of the hollow body.

42. An underwater excavation apparatus is claimed in claim 34, wherein the at least one moving means is provided above the at least one outlet portion.

43. An underwater excavation apparatus as claimed in claim 34 wherein the at least one moving means comprise means for orienting, positioning, rotating and/or steering the apparatus.

44. An underwater excavation apparatus as claimed in claim 34, wherein the/each moving means allows for required achievement and maintenance of a desired position/orientation of the apparatus.

45. An underwater excavation apparatus as claimed in claim 34, wherein the moving means is capable of moving the apparatus:

forward and/or backward;

to one side and/or to another side;

up/and or down;

rotationally around a vertically extending axis in one and/or another direction;

rotatably around at least one or two perpendicular horizontally extending axis/axes in one and/or another direction.

46. An underwater excavation apparatus as claimed in claim 34, wherein the moving means causes, in use, is adapted to provide one or more jets of fluid, such as of the underwater fluid.

47. An underwater excavation apparatus as claimed in claim 34, wherein the moving means comprise a plurality of moving means.

48. An underwater excavation apparatus as claimed in claim 34, wherein the moving means comprise at least one pair of moving means, which are substantially symmetrically disposed at or adjacent to the at least one first and second inlet portions of the apparatus.

49. An underwater excavation apparatus as claimed in claim 48, wherein a first pair of moving means are disposed at or adjacent an upper surface of the at least one first and second inlet portions of the apparatus and/or at or near ends of the at least one first and second inlet portions of the apparatus.

50. An underwater excavation apparatus as claimed in claim 48, wherein a pair/second pair of moving means are disposed at or adjacent to respective opposing faces of the apparatus.

51. An underwater excavation apparatus as claimed in claim 34, wherein the moving means are connected/connectable to the excavation apparatus, such as by connection means such as brackets or arms.

52. An underwater excavation apparatus as claimed in claim 34, wherein the/each moving means comprises at least one propeller/blade/further impeller mounted for rotation.

53. An underwater excavation apparatus as claimed in claim 52, wherein the/each moving means comprise a body having a through passage.

54. An underwater excavation apparatus as claimed in claim 53, wherein the/each moving means comprises at least one further impeller and the body has a through passage comprising a hollow cylindrical body, the/each respective further impeller is mounted in the respective cylindrical body for rotation around a longitudinal axis of the through passage.

55. An underwater excavation apparatus as claimed in claim 52, wherein the/each moving means comprises at least one further impeller, the apparatus comprises means for driving the/each further impeller.

56. An underwater excavation apparatus as claimed in claim 55, wherein the/each driving means comprises an electrically or hydraulically drive means.

57. An underwater excavation apparatus as claimed in claim 55, wherein the/each driving means is adapted to selectably drive the respective further impeller in either direction of rotation.

58. An underwater excavation apparatus as claimed in claim 55, wherein the driving means is adapted to drive the respective further impeller in a single direction of rotation.

59. An underwater excavation apparatus as claimed in claim 52, wherein the moving means comprises at least one further impeller, and the impeller and the at least one further impeller of the moving means are rotatable in different directions so as to cause the apparatus to rotate around a substantially vertically extending axis.

60. An underwater excavation apparatus as claimed in claim 52, wherein the moving means comprises at least one further impeller, and the impeller and the at least one further impeller of the moving means are rotatable in the same direction so as to cause the apparatus to move in a selected direction.

61. An underwater excavation apparatus as claimed in claim 34, wherein the/each moving means comprises a nozzle and valve arrangement.

62. An underwater excavation apparatus as claimed in claim 61, wherein there are provided at least one pair of opposing nozzles and associated valves to provide for rotational movement in either direction around a substantially vertically extending axis.

63. An underwater excavation apparatus as claimed in claim 61, wherein there are provided two pairs of nozzles at either end of the first and second inlet portions of the apparatus, control of the valves providing that, in use, the apparatus can be caused to rotate and/or move forward and backward, and/or from side to side.

64. An underwater excavation apparatus as claimed in claim 34, wherein the apparatus comprises means for connecting or tethering and/or securing the apparatus to a vessel.

65. An underwater excavation apparatus as claimed in claim 64, wherein the means for connecting, tethering, and/or securing comprises at least one eye, the/each eye being capable or receiving a cable, line or tether extending from the vessel.

66. An underwater excavation apparatus as claimed in claim 65, wherein the at least one eye comprises at least one pair of eyes, which pair of eyes are substantially symmetrically disposed on the apparatus, such as on an uppermost surface thereof at or adjacent opposing ends thereof.

67. An underwater excavation apparatus as claimed in claim 64, wherein, the means for connecting, tethering and/or securing are adapted to roughly, approximately or coarsely position and/or locate the apparatus, and the at least one moving means are adapted to more exactly, precisely or finely position, locate and/or orientate the apparatus.

68. An underwater excavation apparatus as claimed in claim 34, wherein the driving means are adapted to cause the impellers to be driven in contrary rotating direction.

69. An underwater excavation apparatus as claimed in claim 34, wherein the at least one first and second inlets are inclined at an angle to the first axis along which the at least one outlet portion is provided.

70. An underwater excavation apparatus as claimed in claim 34, wherein the at least one first and second inlets are substantially symmetrically disposed around the first axis extending from the outlet portion.

71. An underwater excavation apparatus as claimed in claim 34, wherein the at least one first and second inlet portions comprises at least one horizontally, or at least partly horizontally, opposed first and second respective inlets and the at least one outlet portion comprises a single outlet, the first and second inlets communicating with the single outlet, the single outlet being disposed vertically downwards substantially midway between the first and second inlets.

72. An underwater excavation apparatus as claimed in claim 34, wherein the at least one first and second inlets communicate with a single outlet, the first and second inlets being substantially symmetrically disposed around the first axis extending from the single outlet portion, the single outlet being disposed vertically downwards substantially midway between the first and second inlets.

73. An underwater excavation apparatus as claimed in claim 68, wherein at least one impeller(s) is provided within/adjacent each inlet.

74. An underwater excavation apparatus as claimed in claim 34, wherein the underwater excavation apparatus further comprises an agitator device having mechanical disturbance means and fluid flow disturbance means.

75. An underwater excavation apparatus as claimed in claim 34, wherein the underwater excavation apparatus, is adapted to be suspended from a surface vessel, in use.

76. An underwater excavation apparatus as claimed in claim 34, wherein the underwater apparatus comprises the hollow body having the at least one first and second inlet portion comprising first and second respective inlets, the first and second inlets communicating with the outlet portion, the at least one pair of impellers rotatably mounted in the hollow body and means for driving the impellers, the first and second inlets being substantially symmetrical disposed around the first axis extending from the outlet portion, wherein the first and second inlets are not horizontally opposed to one another.

77. An underwater excavation apparatus as claimed in claim 43, wherein the at least one moving means comprises means for rotating the apparatus around at least one vertical axis and/or at least one horizontal axis.

78. A method of underwater excavation comprising:

providing an excavation apparatus according to claim 34;

excavating an underwater area using the excavation apparatus.

79. An underwater excavation apparatus as claimed in claim 1, wherein the at least one further moving means is provided above the at least one outlet portion.

80. An underwater excavation apparatus is claimed in claim 34, wherein the at least one outlet portion is provided vertically between the at least first and second moving means and the at least one first and second inlet portions.

81. An underwater excavation apparatus is claimed in claim 34, wherein the outlet portion comprises at least one outlet, the at least one outlet being downward facing and each inlet of the at least one first and second inlet portions being laterally facing.

82. An underwater excavation apparatus as claimed in claim 34, wherein the first and second inlets portions comprise at least one first and second respective branch of the hollow body.

83. An underwater excavation apparatus comprising means for providing a flow of underwater fluid comprising a hollow body having at least one first inlet portion comprising at least one respective first inlet, at least one second inlet portion comprising at least one respective second inlet, and at least one outlet portion, the at least one first and second inlet portions being substantially symmetrically disposed around a first axis extending from the outlet portion, the at least one first and second inlets being opposed to one another, at least one pair of impellers rotatably mounted coaxially in the hollow body and means for driving the impellers, wherein, in use, the driving means cause the impellers to be driven in contrary rotating directions, and at least one means for moving the underwater excavation apparatus during excavation comprising at least one first and at least one second moving means, the at least one first and second moving means being provided above the respective at least one first and second inlet portions for counteracting reactive torque of the underwater excavation apparatus, wherein the at least one first and second moving means each comprises at least one further impeller mounted for rotation in a common plane of rotation, the common plane of rotation being coincident with the first axis and with a second axis, the second axis extending between the first and second inlets and perpendicularly intersecting the first axis, wherein the at least one first and second moving means are capable of counteracting reactive torque by exerting thrust on the apparatus from one or more jets of fluid generated by at least one of the at least one first and second moving means during excavation.

84. An underwater excavation apparatus as claimed in claim 83, wherein the at least one moving means comprise means for orienting, positioning, rotating, and/or steering the apparatus.

85. An underwater excavation apparatus as claimed in claim 83, wherein the at least one first and second moving means are substantially symmetrically disposed on or adjacent to the at least one first and second inlet portions of the apparatus.

86. An underwater excavation apparatus as claimed in claim 83, wherein each of the at least one first and second moving means further comprises a body having a through passage and wherein the at least one further impeller is mounted in the respective body for rotation around a longitudinal axis of the through passage.

87. An underwater excavation apparatus as claimed in claim 83, wherein the at least one first and second moving means are substantially symmetrically disposed on or adjacent to the at least one first and second inlet portions of the apparatus and wherein the at least one further impeller comprises at least a pair of impellers rotatable in different directions so as to cause the apparatus to rotate around a substantially vertically extending axis.

88. An underwater excavation apparatus as claimed in claim 83, wherein the at least one first and second moving means are substantially symmetrically disposed on or adjacent to the at least one first and second inlet portions of the apparatus and wherein the at least one further impeller comprises at least a pair of impellers that are caused to rotate in the same direction so as to cause the apparatus to move in a direction, selected from the group consisting of forward, backward, to one side, to another side and combinations thereof.

89. An underwater excavation apparatus comprising means for providing a flow of underwater fluid comprising a hollow body having at least one first inlet portion comprising at least one respective first inlet, at least one second inlet portion comprising at least one respective second inlet, and at least one outlet portion, the at least one first and second inlet portions being substantially symmetrically disposed around a first axis extending from the outlet portion, the at least one first and second inlets being opposed to one another, at least one pair of impellers rotatably mounted coaxially in the hollow body and means for driving the impellers, wherein, in use, the driving means cause the impellers to be driven in contrary rotating directions, and at least one means for moving the underwater excavation apparatus during excavation comprising at least one first and at least one second moving means, the at least one first and second moving means being provided above the respective at least one first and second inlet portions for counteracting reactive torque of the underwater excavation apparatus, wherein the at least one first and second moving means each comprises at least one further impeller mounted for rotation in a common plane of rotation, the common plane of rotation being coincident with the first axis and with a second axis, the second axis extending between the first and second inlets and perpendicularly intersecting the first axis, and wherein the at least one first and second moving means are capable of moving the apparatus forward and/or backward; to one side and/or to another side; up and/or down; rotationally around a vertically extending axis in one and/or another direction rotatably around at least one/two perpendicular horizontally extending axis/axes in one and/or another direction.

90. An underwater excavation apparatus as claimed in claim 89, wherein the at least one moving means comprise means for orienting, positioning, rotating and/or steering the apparatus.

91. An underwater excavation apparatus as claimed in claim 89, wherein the moving means causes production of one or more jets of underwater fluid.

92. An underwater excavation apparatus as claimed in claim 89, wherein each of at least one first and second moving means further comprises a body having a through passage and wherein the at least one further impeller is mounted in the respective body for rotation around a longitudinal axis of the through passage.

93. An underwater excavation apparatus as claimed in claim 89, wherein the at least one first and second of moving means are substantially symmetrically disposed on or adjacent to the at least one first and second inlet portions of the apparatus and wherein the at least one further impeller comprises at least a pair of impellers rotatable in different directions so as to cause the apparatus to rotate around a substantially vertically extending axis.

94. An underwater excavation apparatus as claimed in claim 89, wherein the at least one first and second moving means are substantially symmetrically disposed on or adjacent to the at least one first and second inlet portions of the apparatus and wherein the at least one further impeller comprises at least a pair of impellers that are caused to rotate in the same direction so as to cause the apparatus to move in a direction, selected from one of forward, backward, to one side, to another side and combinations thereof.

95. An underwater excavation apparatus comprising means for providing a flow of underwater fluid comprising a hollow body having at least one first inlet portion comprising at least one respective first inlet, at least one second inlet portion comprising at least one respective second inlet and at least one outlet portion, the at least one first and second inlet portions being substantially symmetrically disposed around a first axis extending from the outlet portion, the at least one first and second inlets being opposed to one another, at least one pair of impellers rotatably mounted coaxially in the hollow body and means for driving the impellers, wherein, in use, the driving means cause the impellers to be driven in contrary rotating directions, and at least one means for moving the underwater excavation apparatus during excavation comprising at least one first and at least one second moving means, the at least one first and second moving means being provided above the respective at least one first and second inlet portions for counteracting reactive torque of the underwater excavation apparatus, wherein the at least one first and second moving means each comprises at least one further impeller mounted for rotation in a common plane of rotation, the common plane of rotation being coincident with the first axis and a second axis which extends between the first and second inlets and perpendicularly intersects the first axis, and wherein the underwater excavation apparatus is suspended from a surface vessel at a distance from an underwater area during excavation.

96. An underwater excavation apparatus as claimed in claim 95, wherein the at least one moving means comprise means for orienting, positioning, rotating, counteracting reactive torque and/or steering the apparatus.

97. An underwater excavation apparatus as claimed in claim 95, wherein the moving means is capable of moving the apparatus forward and/or backward; to one side and/or to another side; up and/or down; rotationally around a vertically extending axis in one and/or another direction rotatably around at least one/two perpendicular horizontally extending axis/axes in one and/or another direction.

98. An underwater excavation apparatus as claimed in claim 95, wherein the apparatus comprises means for connecting or tethering and/or securing the apparatus to a vessel comprising at least one pair of eyes, the at least one pair of eyes being capable of receiving a cable, line or tether extending from the vessel and wherein the at least one pair of eyes are substantially symmetrically disposed on the apparatus on either an uppermost surface of the apparatus or at adjacent opposing ends of the apparatus.

99. An underwater excavation apparatus as claimed in claim 95, wherein the apparatus further comprises means for connecting or tethering and/or securing the apparatus to a vessel and wherein the means for connecting, tethering and/or securing are adapted to roughly, approximately or coarsely position and/or locate the apparatus, and the at least one moving means is adapted to more exactly, precisely or finely position, locate and/or orientate the apparatus.

100. A method of underwater excavation comprising:

providing an underwater excavation apparatus comprising means for providing a flow of underwater fluid comprising a hollow body having at least one first inlet portion comprising at least one respective first inlet, at least one second inlet portion comprising at least one respective second inlet and at least one outlet portion, the at least one first and second inlet portions being substantially symmetrically disposed around a first axis extending from the outlet portion, the at least one first and second inlets being opposed to one another, at least one pair of impellers rotatably mounted coaxially in the hollow body and means for driving the impellers, wherein, in use, the driving means cause the impellers to be driven in contrary rotating directions, and at least one means for moving the underwater excavation apparatus during excavation, comprising at least one first and at least one second moving means, the at least one first and second moving means being provided above the respective at least one first and second inlet portions for counteracting reactive torque of the underwater excavation apparatus, wherein the at least one first and second moving means each comprises at least one further impeller mounted for rotation in a common plane of rotation, the common plane of rotation being coincident with the first axis and a second axis which extends between the first and second inlets and perpendicularly intersects the first axis;

suspending the underwater excavation apparatus from a vessel at a distance from an underwater area;

roughly positioning the underwater excavation apparatus by movement of a vessel;

excavating an underwater area using the underwater excavation apparatus;

precisely positioning the underwater excavation apparatus using the at least one moving means during excavation of an underwater area.

101. A method of underwater excavation comprising:

providing an excavation apparatus comprising means for providing a flow of underwater fluid comprising a hollow body having at least one first inlet portion comprising at least one respective first inlet, at least one second inlet portion comprising at least one respective second inlet, and at least one outlet portion, the at least one first and second inlet portions being substantially symmetrically disposed around a first axis extending from the outlet portion, the at least one first and second inlets being opposed to one another, at least one pair of impellers rotatably mounted coaxially in the hollow body and means for driving the impellers, wherein, in use, the driving means cause the impellers to be driven in contrary rotating directions, and at least one means for moving the underwater excavation apparatus during excavation comprising at least one first and at least one second moving means, the at least one first and second moving means being provided above the respective at least one first and second inlet portions for counteracting reactive torque of the underwater excavation apparatus, wherein the at least one first and second moving means each comprises at least one further impeller mounted for rotation in a common plane of rotation, the common plane of rotation being coincident with the first axis and with a second axis which extends between the first and second inlets and perpendicularly intersects the first axis;

suspending the underwater excavation apparatus from a vessel at a distance from an underwater area;

positioning the underwater excavation apparatus by movement of a vessel;

excavating an underwater area using the underwater excavation apparatus;

counteracting reactive torque by exerting thrust on the underwater excavation apparatus from one or more jets of fluid generated by the at least one of the first and second moving means during excavation of an underwater area.

102. In combination a surface vessel and an underwater excavation apparatus, the underwater excavation apparatus being suspended from the surface vessel by a tether at a distance from an underwater area during excavation, for roughly positioning the underwater excavation apparatus; the underwater excavation apparatus comprising means for providing a flow of underwater fluid comprising a hollow body having at least one first inlet portion comprising at least one respective first inlet, at least one second inlet portion comprising at least one respective second inlet and at least one outlet portion, the at least one first and second inlet portions being substantially symmetrically disposed around a first axis extending from the outlet portion, the at least one first and second inlets being opposed to one another, at least one pair of impellers rotatably mounted coaxially in the hollow body and means for driving the impellers, wherein, in use, the driving means cause the impellers to be driven in contrary rotating directions, and at least one means for moving the underwater excavation apparatus during excavation, comprising at least one first and at least one second moving means, the at least one first and second moving means being provided above the respective at least one first and second inlet portions for counteracting reactive torque of the underwater excavation apparatus, wherein the at least one first and second moving means each comprises at least one further impeller mounted for rotation in a common plane of rotation, the common plane of rotation being coincident with the first axis and a second axis which extends between the first and second inlets and perpendicularly intersects the first axis, and wherein the apparatus is precisely positioned by using the at least one moving means during excavation of an underwater area.

* * * * *